US006955530B2

(12) United States Patent
Ciccarelli, Jr. et al.

(10) Patent No.: US 6,955,530 B2
(45) Date of Patent: Oct. 18, 2005

(54) FAN MOTOR BRACKET AND BAFFLE ASSEMBLY

(75) Inventors: Robert A. Ciccarelli, Jr., Kent, OH (US); David B. Finkenbinder, Ravenna, OH (US); William H. McCloud, Jr., Stow, OH (US)

(73) Assignee: Ametek, Inc., Kent, OH (US)

( * ) Notice: Subject to any disclaimer, the term of this patent is extended or adjusted under 35 U.S.C. 154(b) by 0 days.

(21) Appl. No.: 10/805,148

(22) Filed: Mar. 19, 2004

(65) Prior Publication Data

US 2004/0175282 A1 Sep. 9, 2004

Related U.S. Application Data

(63) Continuation of application No. 10/290,724, filed on Nov. 8, 2002, now Pat. No. 6,736,615.

(51) Int. Cl.[7] ..... F04B 17/00; F04B 35/00; H01K 5/16; H01K 5/00

(52) U.S. Cl. ..... 417/423.15; 417/423.12; 417/423.14; 417/360; 310/90; 310/91

(58) Field of Search ..... 417/423.15, 360, 417/423.7, 423.12, 423.14; 310/90, 239, 91

(56) References Cited

U.S. PATENT DOCUMENTS 3,624,434 A 11/1971 Dafler et al. ..... 310/60 R
3,771,911 A 11/1973 Turci ..... 417/413.1
3,791,774 A 2/1974 Vonk ..... 417/423.2
4,110,676 A 8/1978 Edick et al. ..... 322/31
4,166,968 A * 9/1979 Prittie ..... 310/239
4,322,647 A 3/1982 Neroda et al. ..... 310/71
4,538,971 A 9/1985 Miller et al. ..... 417/423.2
4,746,828 A 5/1988 Nado et al. ..... 310/90
4,769,572 A 9/1988 Voigt ..... 310/68 D
4,777,395 A * 10/1988 Taylor et al. ..... 310/90
4,824,333 A * 4/1989 Erickson, Jr. ..... 417/360
4,978,281 A * 12/1990 Conger, IV ..... 417/423.15
5,110,266 A * 5/1992 Toyoshima et al. ..... 417/312
6,133,661 A * 10/2000 Okawa et al. ..... 310/90
6,736,615 B1 * 5/2004 Ciccarelli, Jr. et al. . 417/423.12

* cited by examiner

*Primary Examiner*—Timothy P. Solak
(74) *Attorney, Agent, or Firm*—Renner, Kenner, Greive, Bobak, Taylor & Weber

(57) ABSTRACT

A fan/motor assembly having an integrated brush support and bearing retainer is disclosed. The fan/motor assembly includes a rotatable shaft, a working air fan coupled to the shaft, and a motor bracket and baffle assembly interposed between the working air fan and the motor assembly. The motor bracket and baffle assembly retains a bearing which rotatably receives the shaft and provides integral brush boxes for the motor assembly.

16 Claims, 5 Drawing Sheets

FAN MOTOR BRACKET AND BAFFLE ASSEMBLY

CROSS REFERENCE TO RELATED APPLICATION

This is a continuation of patent application Ser. No. 10/290,724, filed Nov. 8, 2002, now U.S. Pat. No. 6,736,615 entitled "Brush and Bearing Holder for a Fan/Motor".

TECHNICAL FIELD

The present invention is directed generally to fan/motor assemblies having a rotatable shaft. In particular, the present invention is directed a fan/motor assembly which has a fan end bracket that carries a brush mechanism and also retains a bearing assembly.

BACKGROUND ART

It is well known that wet/dry vacuum cleaners such as those known as utility vacs and carpet extractors, operate in an environment in which the debris, which is extracted from the surface being cleaned, is laden in a mixture of air and water. In order to prevent the moisture laden air from entering the vacuum generating motor, bypass motors are typically used in these operations. As is known to those skilled in the art, a bypass motor/fan assembly is one which the working air, generated by a working air fan, never passes through the motor and is totally isolated from the motor. The motor itself may have a separate motor cooling air fan which draws cooling air over the motor armature and field. Accordingly, the working air and the motor cooling air take totally separate paths, and do not mix—except possibly in an exhaust area. While both the motor cooling fan and the working fan operate on the same motor shaft, in a bypass motor, the chambers for the working air and motor cooling air are separate and distinct from each other such that moisture laden air never enters the motor assembly.

Bypass motors have a working air fan at an end of the motor/fan shaft, with the fan rotating within an enclosure which is sometimes called a shroud. The shroud may be a separately manufactured part or it may be an integral part of the vacuum assembly. In any event, the enclosure, along with a fan end bracket, defines a chamber within which the fan operates. One portion of the fan enclosure is provided with an air intake, with a circumference or periphery of the enclosure defined by a single outlet tube or a plurality of spaced apart exhaust apertures. The intake aperture communicates with a vacuum chamber and the cleaning device, while the exhaust apertures communicate with the ambient air. Typically, the enclosure simply defines the chamber in which the fan rotates and accordingly, that chamber becomes pressurized such that the air therein eventually finds its way to an exhaust port.

Assembly of these fan motor assemblies includes many different parts. Typically, the motor housing includes a slot or section that holds a pair of motor brushes which are placed in contact with the commutator of the motor assembly. Each motor brush is slidably contained within a tube, wherein the tube is secured to the motor housing by a strap secured with fasteners. Known fan end bracket assemblies position and orient the motor shaft with an inserted press-fit motor bearing. Retaining the bearing in this manner is problematic in that the bearing may loosen from the end bracket and cause damage to the motor. Although it is known to provide integrated brush box support with the motor housing, it is not known to use a retainer with the brush boxes to retain the motor bearing.

Therefore, there is a need in the art for a motor/fan assembly with an integrated brush support and bearing retainer which reduces the number of parts and thus the number of manufacturing operations.

SUMMARY OF THE INVENTION

It is therefore a primary object of the present invention to provide a fan/motor assembly with integrated brush support and bearing retainer.

Another object of the present invention, which shall become apparent as the detailed description proceeds, is achieved by a fan motor assembly having an integrated brush support and bearing retainer comprising: a motor assembly having a rotatable shaft; a working air fan coupled to the shaft; and a motor bracket and baffle assembly interposed between the working air fan and the motor assembly, the motor bracket and baffle assembly retaining a bearing which rotatably receives the shaft.

Other aspects of the present invention are attained by a bottom motor bracket and baffle assembly interposed between a motor assembly having a shaft, and a fan assembly rotated by the shaft, the baffle assembly, comprising: a bracket for carrying the motor assembly; a bearing carried by the bracket, the bearing rotatably receiving the shaft; and a retainer secured to the bracket and holding the bearing in place.

These and other objects of the present invention, as well as the advantages thereof over existing prior art forms, which will become apparent from the description to follow, are accomplished by the improvements hereinafter described and claimed.

BRIEF DESCRIPTION OF THE DRAWINGS

For a complete understanding of the objects, techniques and structure of the invention, reference should be made to the following detailed description and accompanying drawings, wherein.

BEST MODE FOR CARRYING OUT THE INVENTION

Figure 1:
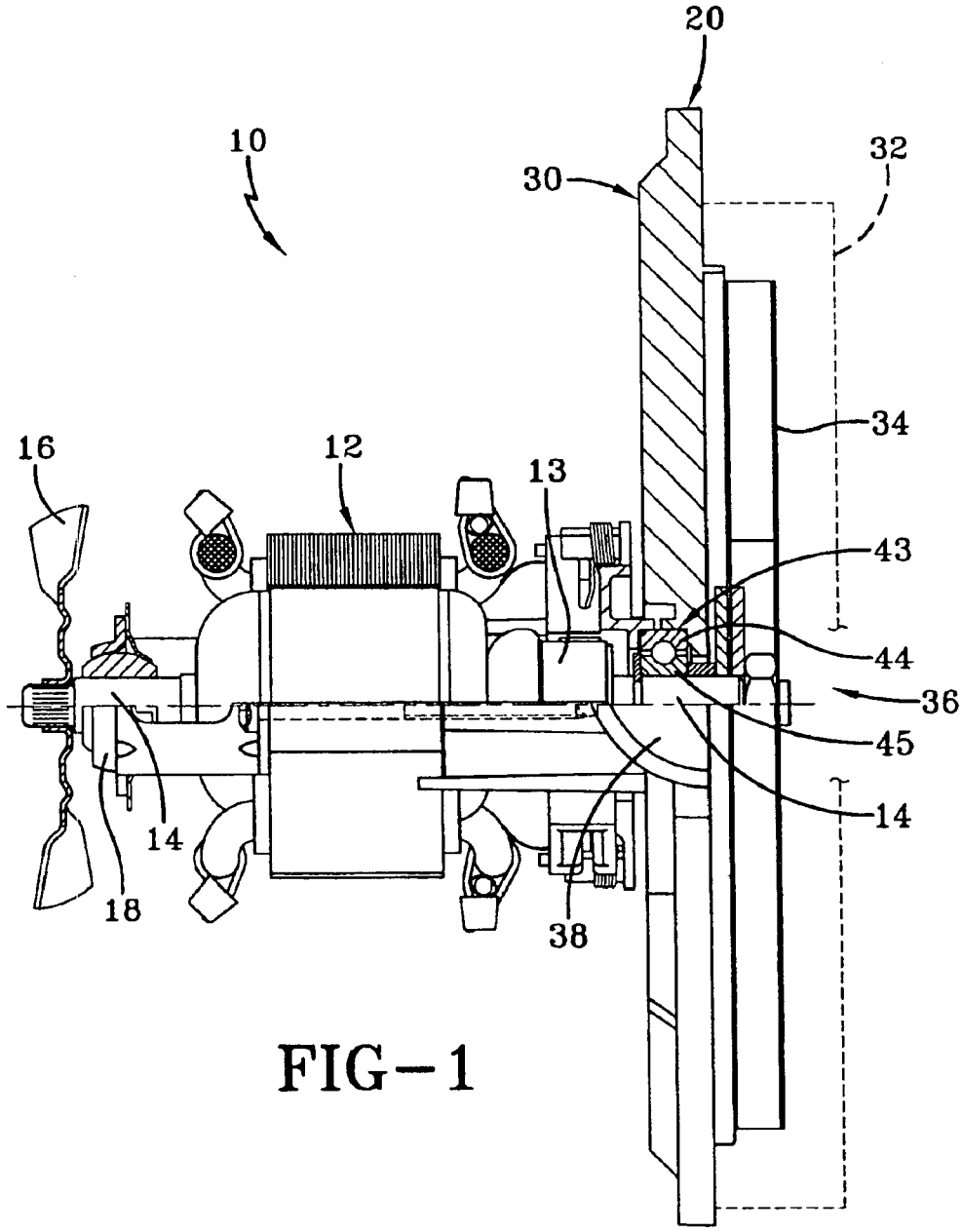
FIG. 1 is an elevational view of a partially broken away of the fan/motor assembly according to the present invention.

Referring now to the drawings and in particular to FIG. 1 it can be seen that a fan/motor assembly within an integrated brush support and bearing retainer is designated generally by the numeral 10. The fan/motor assembly 10 includes a motor assembly 12 which has an armature and a field assembly as is well known in the art and wherein the armature assembly includes a commutator 13. Extending through the motor assembly 12 is a rotatable motor shaft 14 which carries a cooling fan 16 at one end. Interposed between the cooling fan 16 and the motor assembly is an end bracket 18 which carries a bearing that assists in the proper rotation of the motor shaft 14. Disposed at the other end of the motor assembly 12 is a fan housing assembly designated generally by the numeral 20. The fan housing assembly 20 includes a bottom motor bracket and baffle assembly designated generally by the numeral 30 and a top shroud 32 which mates with the baffle assembly. It will be appreciated that the top shroud 32 may be a stand alone manufactured piece or in the alternative it may be integral with the vacuum equipment to which the motor assembly 12 is coupled. In any event, a working air fan 34 is rotatable within the shroud 32 or vacuum equipment and is connected to the other end of the motor shaft 14. The shroud 32 provides an inlet 36 to draw in working air which is then exhausted out an outlet 38 which is only partially shown in FIG. 1. Although this embodiment describes a single outlet aperture for the working air, it will be appreciated that multiple apertures may be used.

Figure 2:
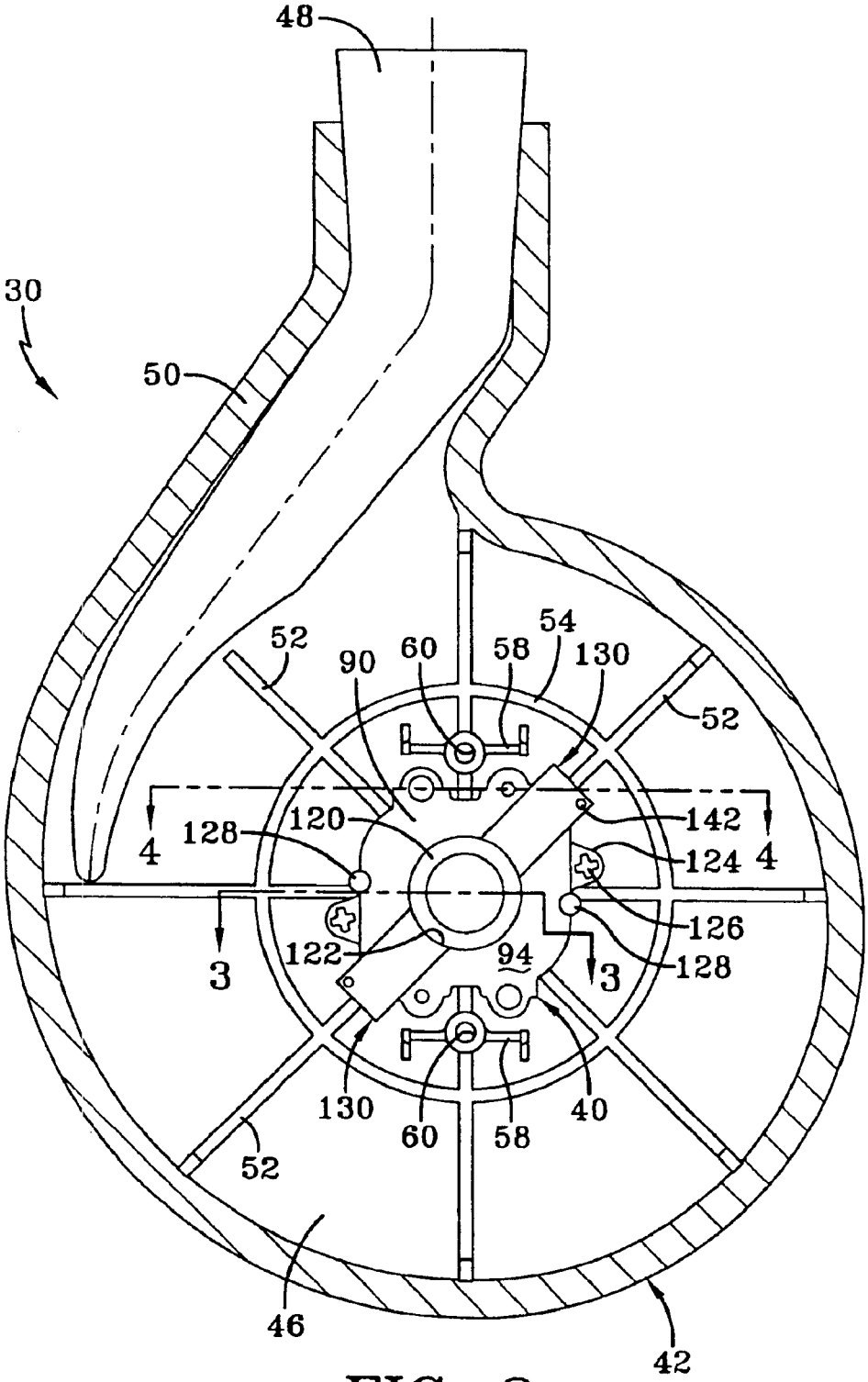
FIG. 2 is top elevational view of a bottom motor bracket and baffle assembly according to the present invention.
Figure 3:
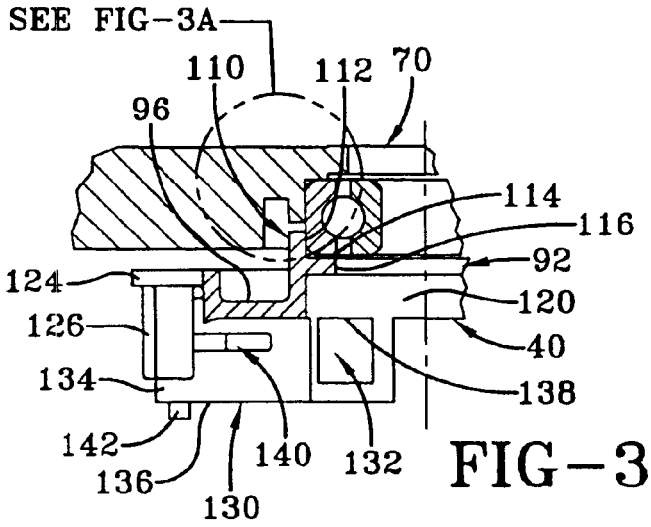
FIG. 3 is a partial, cross-sectional view of the baffle assembly taken substantially along lines 3—3 of FIG. 2.
Figure 4:
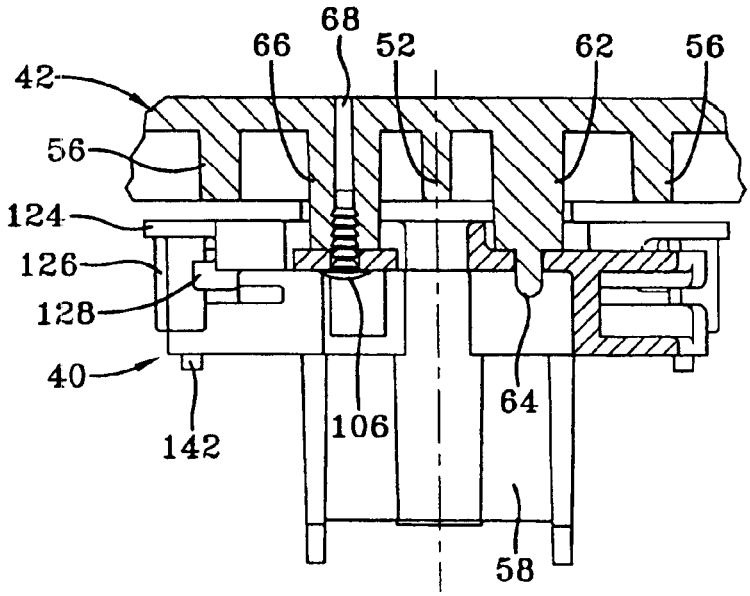
FIG. 4 is a partial, cross-sectional view of the baffle assembly taken substantially along lines 4—4 of FIG. 2.

Referring now to FIGS. 2–4 it can be seen that the baffle assembly 30 includes a retainer designated generally by the numeral 40 and a bracket designated generally by the numeral 42. The complete baffle assembly 30 is shown in FIGS. 2–4, while the bracket 42 is specifically shown in FIG. 5 and the retainer is shown specifically in FIG. 6. Briefly, the retainer 40 and the bracket 42 are coupled to one another and are constructed so as to capture a bearing 43 therebetween. The bearing includes an outer race 44 which is held in place by the retainer 40 and the bracket 42, and an inner race 45 which is secured to the rotating shaft 14. Accordingly, this assembly only includes three parts and significantly reduces the time required for the assembling of the motor assembly 10.

Figure 5:
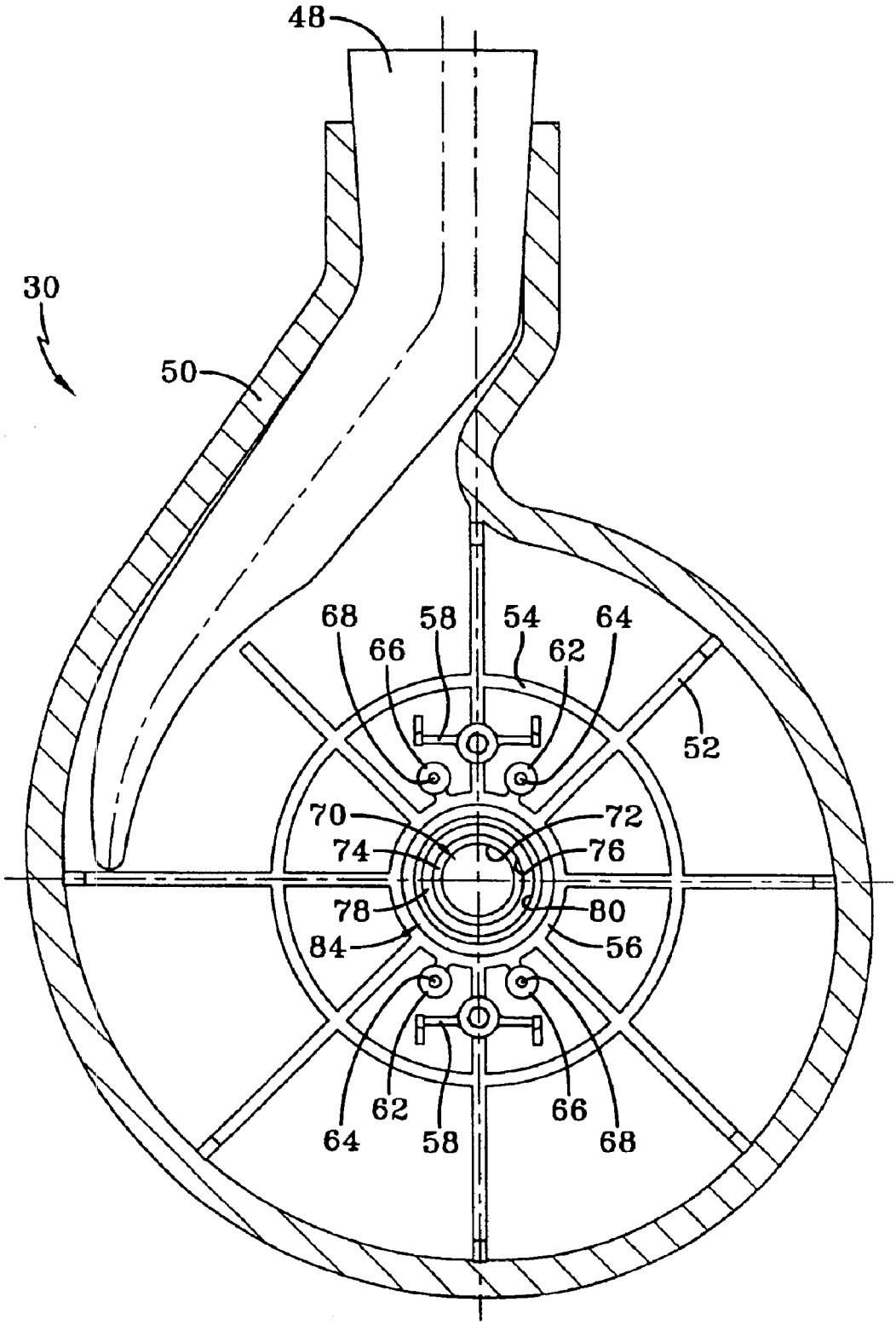
FIG. 5 is a top elevational view of just the cover plate according to the present invention.
Figure 6:
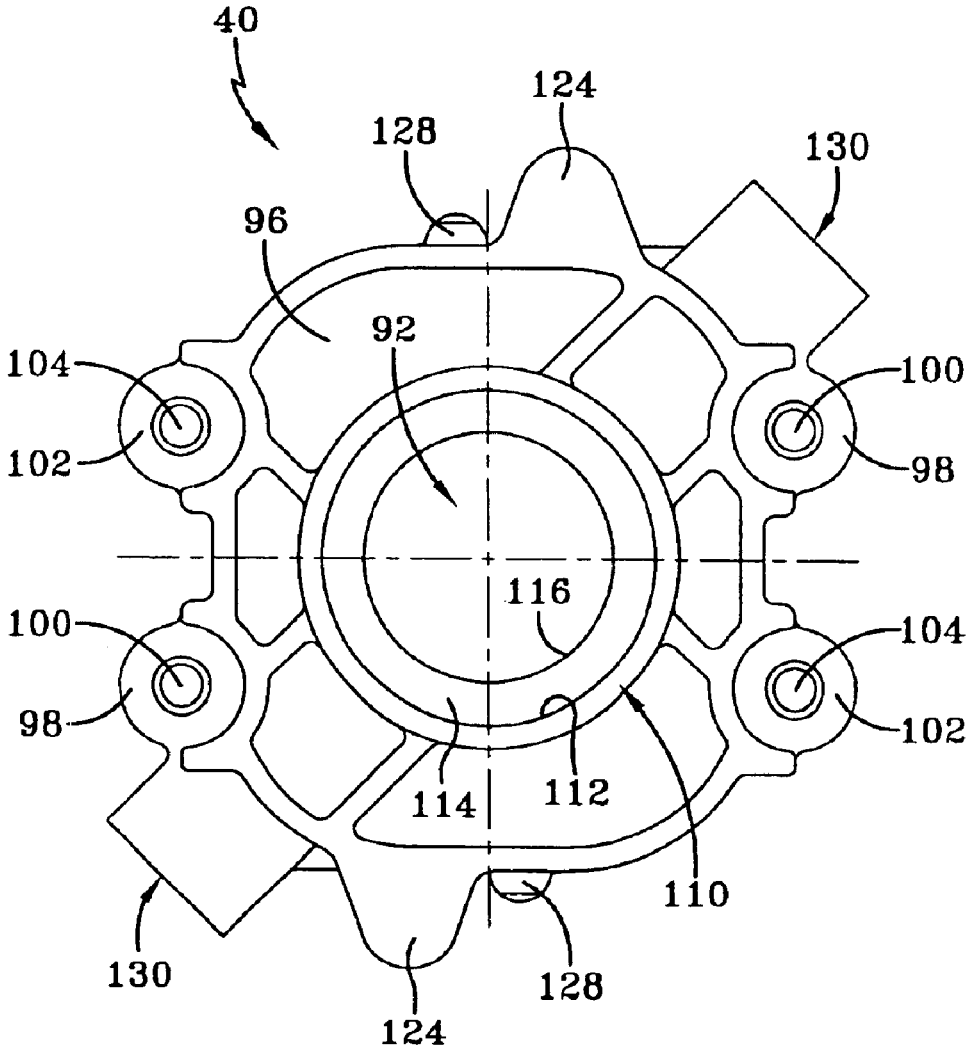
FIG. 6 is a bottom elevational view of just a retainer used in the baffle assembly according to the present invention.

The baffle assembly 30 includes a cover plate 46 wherein the motor side of the cover plate 46 is shown in FIG. 2 and FIG. 5. The cover plate 46 provides an outlet tube 48 which forms a portion of the outlet 38. A substantial periphery of the cover plate 46 is defined by a rim 50. Extending from the motor side of the cover plate 46 are a plurality of radial support ribs 52. These ribs provide structural strength to the cover plate primarily for the purpose of supporting the weight of the motor assembly 12. An outer support ring 54 is connected to the radial support ribs 52 as is an inner support ring 56 which is concentric with the ring 54. A pair of motor mounts 58 extend axially from the cover plate 46 and are positioned within the inner support ring 56. Each motor mount 58 is provided with a mount hole 60 which receives a fastener to secure the motor assembly 12 to the cover plate 46.

Referring now to FIGS. 2, 4 and 5, more specific details of the bracket 42 are presented. In particular, the cover plate 46 has extending therefrom a pair of alignment posts 62 from which further extend a nub 64. Also extending from the cover plate 46 are a pair of fastener posts 66 each of which has a fastener hole 68. As best seen in FIG. 5, the posts 62 and 66 are positioned between the motor mounts 58. Moreover, the alignment posts 62 are positioned diagonally with respect to one another as are the fastener posts 66. In other words, the four posts 62, 66 together form a rectangular shape such that one type of post has the different type of post on either side. And, as can best be seen in FIG. 5, the posts 62 and 66 are positioned between the inner support ring 56 and the outer support ring 54.

Figure 3A:
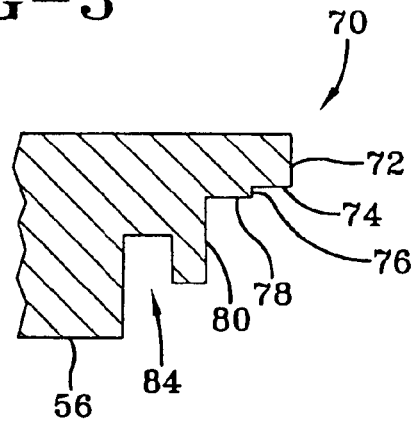
FIG. 3A is partial, cross-sectional view of a cover plate used in the baffle assembly.

Extending through the cover plate 46 at a central position between the motor mounts and the posts 62 and 66 is a bracket hole 70. The bracket hole 70 is defined by a rim 72 as seen in FIGS. 3A and 5. Extending substantially perpendicularly from the rim 72 on the motor side of the cover plate is a ledge 74 from which axially extends a ledge wall 76. Extending substantially perpendicularly from the ledge wall 76 is a step 78 that terminates at a bearing wall 80 which axially extends from the cover plate 46. Although the step 78 and the bearing wall 80 are circular and are concentrically disposed around the bracket hole 70, both the step 78 and the wall 80 may be discontinuous or interrupted with other structural features. A channel 84 is formed between the bearing wall 80 and the inner support ring 56. As best seen in FIG. 3, the outer race 44 is supported by the step 78 in such a manner that the retainer 40, when coupled to the bracket 42 secures the outer race 44 and allows the inner race 45 to freely rotate.

The retainer 40, as best seen in FIGS. 2–4 and FIG. 6, includes a frame 90 which has a retainer hole 92 extending therethrough. When the frame 90 is secured to the bracket 42, the retainer hole 92 is aligned with the bracket hole 70. The frame 90 includes a brush side 94 which faces the motor assembly 12 and a bearing side 96 which faces the cover plate 46 when assembled. Extending from a lateral edge of the brush side 94 are a pair of alignment tabs 98 which have corresponding alignment holes 100. In a similar fashion, a pair of fastener tabs 102 extend from the brush side and they likewise provide a tab hole 104 therethrough. As best seen in FIG. 2, the alignment holes 100 and tab holes 104 are positionable and alignable over the alignment posts 62 and fastener posts 66. In particular, the alignment holes 100 are aligned with and fit over the alignment post nubs 64 while tab holes 104 are aligned with the fastener holes 68. A fastener 106, which may be threaded or not, is insertable into each of the tab holes 104 and the fastener holes 68 for the purpose of securing the retainer 40 to the bracket 42. It will further be appreciated that the alignment posts and nubs and the alignment tabs and fastener tabs may be reconfigured such that various alignment tab and hole configurations could be used. In other words, the retainer could be provided with the alignment posts and nubs while the bracket could be provided with corresponding openings to receive the nubs.

The bearing side 96 includes an outer race collar 110 which concentrically surrounds the retainer hole 92. Extending down the collar 110 is a race flange 112 from which substantially perpendicularly extends a bearing support surface 114. Extending substantially perpendicularly from the support surface 114 is a wall 116 which defines the retainer hole 92 and which extends to the brush side 94.

As best seen in FIGS. 2–4, the brush side 94 provides a brush collar 120 from which perpendicularly extends a commutator wall 122. When the motor assembly is secured to the motor mounts 58, the commutator 13 rotatably fits within the commutator wall 122. When the retainer 40 is secured to the bracket 42, the bearing 43 is readily captured by the outer race collar 110. The bearing support surface 114 and the step 78 together exert a compressive holding force on the outer race 44 while allowing the inner race 45 to freely rotate. Although the outer race collar 110 is a continuous member it could be interrupted with other structural features. The coaction and fit of the components 40, 42 and 43 allow for a simple and cost efficient assembly process.

Extending from the brush side 94 are a pair of pads 124 from which axially extend a spring post 126. Also extending from the brush side 94 are a pair of fingers 128. Diametrically opposed to one another are a pair of brush boxes 130 that are integral with the frame 90. As will be appreciated by those skilled in the art, the brush boxes 130 carry a carbon brush which is placed in contact with the commutator 13. The brush boxes have a brush opening 132 for receiving the brush wherein the opening is defined by a pair of side walls 134 that are connected by a top 136. A brush box bottom 138 is in the same plane as the brush side 94 and connects the other ends of the walls so as to warm a four-sided enclosure for retaining the brush. It will be appreciated that one of the sidewalls 134 provides a spring slot 140. Extending axially from one corner of the brush box top 136 is a spring nub 142.

In order to ensure electrical contact between the brushes and the commutator 13, a spring 146 is employed to bias or assert a continuous force on the brush and make electrical contact with the commutator 13. The spring 146 includes a coil 148 which has a brush end 150 and a bias end 152. The coil 148 fits over the spring post 126 in such a manner that the bias end 152 is retained by a corresponding finger 128. The brush end 150 of the spring is retained by the spring nub 142 until the brush is received within the brush opening 132. Upon completion of the motor manufacturing operation, the brush end 150 is released from the spring nub 142 and provides the constant exertion of force against a back end of the brush so that the front end of the brush is contact with the commutator 13.

Based upon the foregoing the advantages of the present invention are readily apparent. Primarily, the present invention allows for the efficient and quick assembly of a retainer to the bracket while also securing a bearing therebetween. This simplifies the manufacturing process and reduces the related scrap incurred by previous multiple part assemblies. Moreover, the retainer is constructed such as to fit quickly and easily over the posts of the bracket and to allow for receipt of fasteners for securing the bearing therebetween. The motor assembly can then be secured to the motor mounts while the motor brushes are easily installed. Accordingly, the assembly is reliable and cost efficient to manufacture.

Thus, it can be seen that the objects of the invention have been satisfied by the structure and its method for use presented above. While in accordance with the Patent Statutes, only the best mode and preferred embodiment has been presented and described in detail, it is to be understood that the invention is not limited thereto or thereby. Accordingly, for an appreciation of the true scope and breadth of the invention, reference should be made to the following claims.

What is claimed is:

1. A bottom motor bracket and baffle assembly interposed between a motor assembly having a shaft, and a fan assembly rotated by the shaft, the baffle assembly, comprising:

a bracket for carrying the motor assembly comprising a plurality of integral posts extending axially therefrom;

a bearing carried by said bracket, said bearing rotatably receiving the shaft; and a retainer secured to a top portion of said posts and holding said bearing in place wherein said bracket comprises a cover plate, said cover plate having a bracket hole therethrough and a bearing wall disposed about said bracket hole, said bearing positioned within said bearing wall and aligned with said bracket hole.

2. The baffle assembly according to claim 1, wherein said retainer comprises:

a frame, said frame having a retainer hole therethrough; and an outer race collar disposed about said retainer hole, said bearing positioned within said outer race collar and aligned with said retainer hole.

3. The baffle according to claim 2, wherein said bearing has an outer race and an inner race, said bearing wall and said outer race collar capturing said outer race.

4. The baffle assembly according to claim 1, wherein said bracket comprises:

at least one alignment post, and at least one fastener post; and wherein said retainer comprises;

a plurality of tabs, each said tabs having a tab hole therethrough, said tab holes alignable with said at least one alignment post and said at least one fastener post.

5. The baffle according to claim 4, further comprising;

at least one fastener received through said tab hole to secure said retainer to said bracket.

6. The baffle assembly according to claim 1, wherein said retainer comprises:

a frame, said frame having a retainer hole therethrough; and pair of brush boxes extending from said frame and diametrically opposed to one another.

7. The baffle assembly according to claim 6, further comprising:

a pair of spring posts extending axially from said frame; and a spring carried by each said spring post, each said spring having a brush end and bias end.

8. The baffle assembly according to claim 7 wherein each said brush box has extending therefrom a spring nub, said spring nub retaining said brush end.

9. The baffle assembly according to claim 7, wherein said retainer further comprises:

a pair of fingers extending from said frame, each said finger retaining said bias end of said spring.

10. A fan motor assembly having an integrated brush support and bearing retainer comprising:

a motor assembly having a rotatable shaft;

a working air fan coupled to said shaft; and a motor bracket and baffle assembly interposed between said working air fan and said motor assembly, said motor bracket and baffle assembly retaining a bearing which rotatably receives said shaft, said motor bracket and baffle assembly comprising a bracket which includes a plurality of integral posts extending axially therefrom, said motor assembly mounted to said bracket, and a retainer coupled to a top portion of said posts, said bracket and said retainer capturing said bearing therebetween, said retainer comprising a frame having a retainer hole therethrough which is alignable with said bracket hole and an outer race collar extending axially from said frame and around said retainer hole, said outer race collar enclosing at least a portion of said bearing.

11. The assembly according to claim 10, wherein said bracket has a cover plate with a bracket hole therethrough;

said cover plate having a bearing wall extending axially therefrom and around said bracket hole; said bearing wall enclosing at least a portion of said bearing.

12. The assembly according to claim 10, wherein said retainer further comprises:

a bearing support surface extending radially from a race flange, wherein said bearing support surface and a step hold said outer race when said retainer is coupled to said bracket.

13. The assembly according to claim 10, wherein said bracket has a plurality of alignment posts and said retainer has a plurality of alignment holes that are maleable with said alignment posts.

14. The assembly according to claim 13, wherein said bracket has a plurality of fastener posts with fastener holes, said retainer having tab holes alignable with said fastener holes for receiving fasteners to secure said retainer to said bracket.

15. The assembly according to claim 10 wherein said retainer further comprises:

a pair of brush boxes extending from said frame and diametrically opposed to one another;

a pair of spring posts extending from said frame, each said spring post in proximity to one of said corresponding brush boxes; and wherein said fan motor assembly further comprises a spring carried by each said spring post.

16. The assembly according to claim 15, wherein said spring comprises;

a coil having a brush end and a bias end; and said retainer further comprising a pair of fingers extending from said frame, each said finger retaining at bias end of said spring.

* * * * *